United States Patent [19]

Hannula

[11] 4,135,637

[45] Jan. 23, 1979

[54] CENTER VENTING CLOSURE SYSTEM

[75] Inventor: Rodney R. Hannula, Maplewood, Minn.

[73] Assignee: Minnesota Mining and Manufacturing Company, Saint Paul, Minn.

[21] Appl. No.: 875,871

[22] Filed: Feb. 7, 1978

[51] Int. Cl.[2] ..... B65D 41/32

[52] U.S. Cl. ..... 220/271; 220/257; 220/258; 220/359; 220/260; 222/541; 222/485

[58] Field of Search ..... 220/257, 258, 260, 270, 220/271, 359; 222/541, 485; 229/7 R

[56] References Cited

U.S. PATENT DOCUMENTS

| | | | |
|---|---|---|---|
| 2,870,935 | 1/1955 | Houghtelling | 220/270 |
| 3,292,828 | 12/1966 | Stuart | 222/485 |
| 3,339,788 | 9/1967 | Lipske | 220/271 |
| 3,441,167 | 4/1969 | Balocca | 220/271 |
| 3,908,857 | 9/1975 | Chiappe | 220/359 |
| 3,990,603 | 11/1976 | Brochman | 220/260 |

*Primary Examiner*—George T. Hall

*Attorney, Agent, or Firm*—Cruzan Alexander; Donald M. Sell; Dean P. Edmundson

[57] ABSTRACT

An improved easy open closure system is described which includes a combination of center vent opening, pour hole, exterior tape and interior sheet material suitable for containers having therein a pressurized beverage. The exterior tape comprises a grip portion and body portion, the grip portion sealing the center vent opening and overlapping the body portion, which seals the pour hole.

7 Claims, 5 Drawing Figures

CENTER VENTING CLOSURE SYSTEM

BACKGROUND OF THE INVENTION

This invention relates to containers having a preformed opening or pour hole therein covered by a removable (i.e., hand peelable) closure system. More particularly, the present invention relates to an improved combination of vent opening, pour hole, and exterior tape-grip tab intended for use in a closure system of the type where an exterior tape and an interior sheet material are used to seal a container having therein a carbonated beverage.

U.S. Pat. No. 3,990,603 (Brochman), incorporated herein by reference, describes two-tape closure systems and the parameters that must be met by the exterior tape and interior sheet material in a two-tape, easy open closure system in order to contain gas-containing beverages during processing, storage, and ultimate consumption.

The preferred pressure relief opening (venting means) of the Brochman patent is described as being located on the leading edge and contiguous with the pour hole, i.e., near the edge of the container end portion. However, it has been found that opening of a pressurized container while it is tilted tends to spray the contents of the container from the vent opening.

Previously described two-tape closure systems, e.g., U.S. Pat. Nos. 3,990,603 (Brochman), 3,908,857 (Chiappe), 3,292,828 (Stuart), 2,870,935 (Houghtelling), and 3,339,788 (Lipske) employ a continuous, single strip peeling technique in which the tape is peeled from the end of the container in a single direction. Such unidirectinal peeling closure systems occasionally present an unnecessary ambiguity in that the consumer is unsure which end of the external tape is to be first removed.

SUMMARY OF THE INVENTION

In accordance with the present invention there is provided, in one aspect, a hand operable easy-opening closure system of the type wherein flexible exterior tape and interior sheet material are employed to removably seal a pouring means or preformed opening in an end portion of a container adapted to withstand sub-atmospheric to super-atmospheric pressures, the improvement comprising in combination:

a. a vent opening centrally disposed in said end portion said vent opening being of sufficient area so as to permit said exterior tape and interior sheet material to be bonded to each other in the area of said vent opening such that removal of said exterior sheet vents said container to ambient pressures by pulling the portion of said interior sheet in said vent opening, therethrough, the area of said vent opening not being so large as to cause excessive disturbance of the contents of said container during the venting operation;

b. a pour hole, separated from said vent opening, which is disposed adjacent the edge of said end portion;

c. a rectangular exterior tape having a body portion and a grip portion overlapping said body portion, said body portion and grip portion being securely affixed to each other adjacent the edge of said container portion, said body portion being aggressively bonded to said container portion circumjacent and covering said pour hole, and said grip portion being aggressively bonded to said container portion circumjacent and covering said vent opening, wherein said grip portion is aggressively bonded to said interior sheet in the area of said vent opening and said body portion is aggressively bonded to said interior sheet in the area of said pour hole.

The invention thus provides a commercially desirable two-tape closure system with less ambiguity in its mode of operation, that operationally requires gentle venting of the pressurized container.

DETAILED DESCRIPTION OF THE INVENTION

The invention is described in more detail hereinafter with reference to the accompanying drawings wherein like reference characters refer to the same parts throughout the several views and in which.

Figure 1:
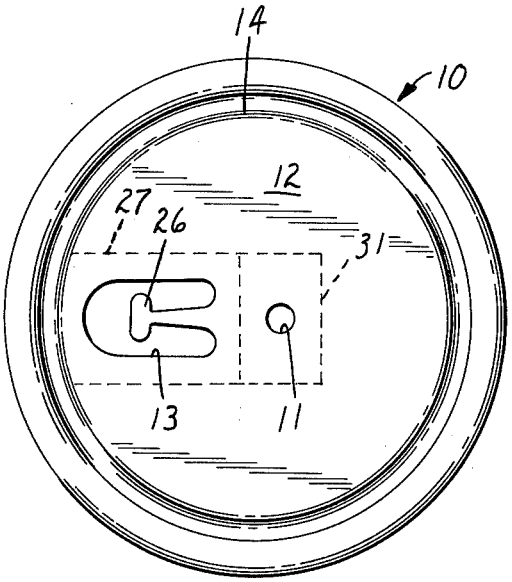
FIG. 1 is a plan view of a preferred container end portion for use in the present closure system.
Figure 2:
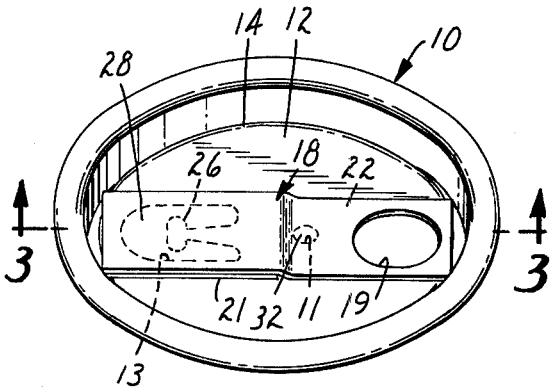
FIG. 2 is a perspective view of one embodiment of the present invention applied to the container end portion of FIG. 1.

Thus, in FIG. 1 there is shown a container end portion 10 (such as might be seamed onto a cylindrical, metal container body) comprising a generally circular, flat, rigid disc or lid 12 defined by an edge 14, the end portion having therein a vent opening 11, and elongated pre-formed opening or pour hole 13. Such an end portion might be produced in large numbers as in a stamping operation. In FIG. 2, the rectangular exterior tape 18, having a body portion 21 and a grip portion 22 folded over the body portion, is shown bonded to the container end portion of FIG. 1. A preferred, but optional, finger hole 19 is also illustrated. The vent hole 11 and pour hole 13 are shown in phantom.

After opening a container having a two-tape, easy open closure system, it is commercially expedient to have some means of directing the removed tape segments away from the pour hole so as not to interfere in the pouring operation. In the embodiment of FIGS. 1 and 2, the means of directing the removed tapes away from the pour hole is a tongue or T-tab 26 (shown in phantom in FIG. 2). In addition to directing the removed tapes away from the pour hole, the tongue, in conjunction with the interior sheet material 20 and the exterior tape 18 (which together effectively coat the tongue 26, reducing exposure of the container contents to bare metal) prevents (up to the breaking point of the exterior tape) total separation of the closure system from the can end 12. Thus, for convenience and environmental reasons, a means for retaining the removed tapes away from the pour hole such as the T-tab 26, is preferred.

Figure 3:
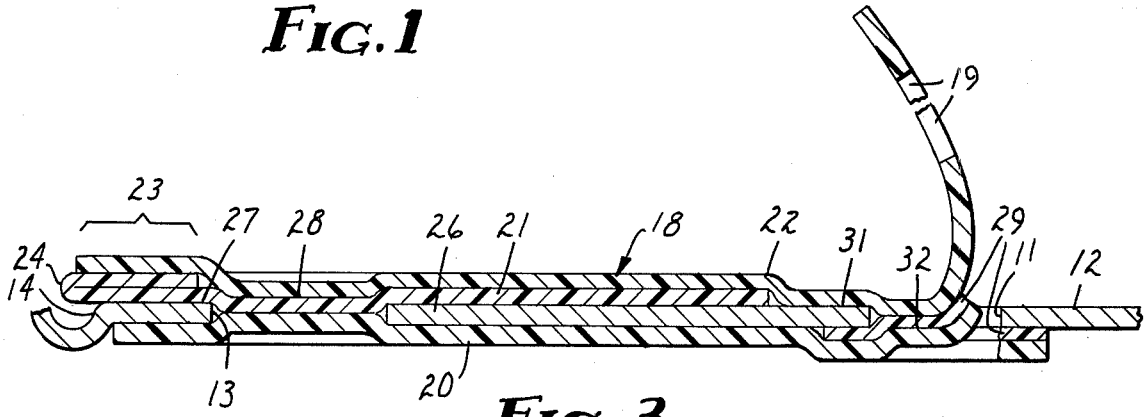
FIG. 3 is a sectional view taken along line 3—3 of FIG. 2 showing the closure system just after the venting operation.

FIG. 3 illustrates more clearly the grip portion of the exterior tape 22, securely bonded to the body portion of the exterior tape 21, at 23, the body portion being folded near the edge 14 of the end portion disc so that the grip portion of the exterior tape overlaps the body portion of the exterior tape. Also clearly shown is the body portion of the exterior tape bonded to the interior sheet material in the area of the pour hole 28, and to the container end portion circumjacent the pour opening 27 including the T-tab 26. Similarly, the grip portion of the exterior tape is bonded to the interior sheet material (by means of an additional adhesive layer 29) in the area of the vent opening 32 and to the container end portion circumjacent the vent opening 31.

Figure 4:
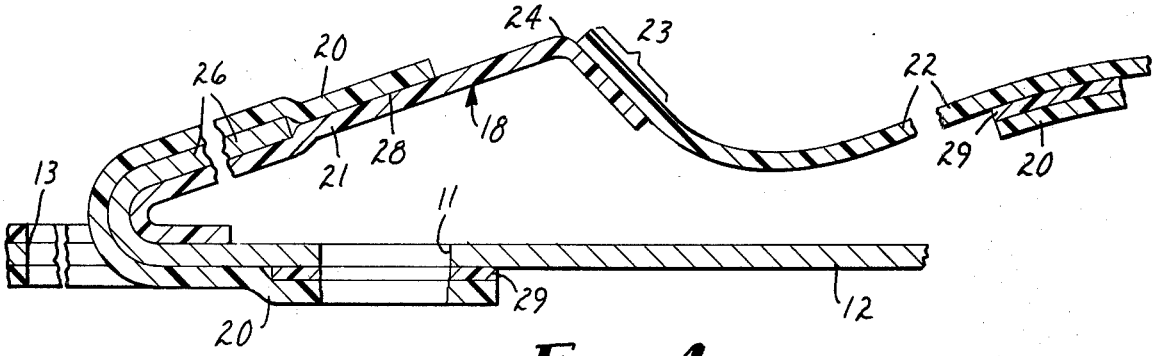
FIG. 4 is a sectional view similar to FIG. 3 after both venting and opening of the container pour hole has occurred.

In FIG. 3 venting of the container to ambient pressure has just occurred. FIG. 4 depicts the closure system after complete opening of the container. Tongue 26 directs the removed tape portions away from the pour hole.

The area of vent opening 11 is critical when the containment of pressurized beverages is desired. Generally, the area of the vent opening must be large enough to permit the exterior tape and interior sheet material to be bonded together in the area of the opening, yet not so large as to cause explosive venting. The preferred vent opening is circular, although other shapes may also be satisfactory. Although the area of the vent opening required to satisfy the above considerations is a function of the thickness of the metal container end portion and the tensile properties of the exterior tape and interior sheet material, for pressurized beverages, the diameter of the preferred circular vent opening is preferably between about ⅛-inches (0.3 cm) and about ¼-inches (0.6 cm). The area of this preferred vent opening is then in the range of about 0.08 $cm^2$ to about 0.3 $cm^2$.

The shape of the pour hole in the invention is not critical. The actual shape employed is largely a balance of pourability and the tendency of the external tape to creep. (Creep is the gradual adhesive failure of the external tape in response to container interior pressure that leads to bubbling of the external tape.) The T-tab discussed above in addition to its other functions helps to reduce creep. Primarily to accommodate existing and easily convertible canning machinery the exterior tape is preferably ¾-inches (2 cm) or less in width. Given the width of the exterior tape, the pour hole must be wide enough to permit the contents of the container to be poured therefrom, yet not be so wide as to leave no significant portion of the container end on which to bond the exterior tape.

Figure 5:
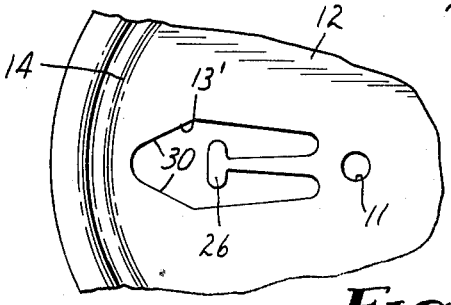
FIG. 5 is a partial plan view of an alternative embodiment of a container end portion.

FIGS. 1 and 5 illustrate two slightly different shapes for the pour hole. The shape of the pour hole in FIG. 5 is advantageous because the shoulders along the leading edge of the pour hole 30, provide very adequate area on which to bond the exterior tape. From the standpoint of pourability, the pour hole shape of FIG. 1 having a maximum width of about 7/16-inches (1 cm) is preferred if a ¾-inch (2 cm) exterior tape is employed.

The operation of the closure system may be visualized by examination of FIGS. 2, 3, and 4. The consumer encounters the top of a carbonated beverage container as depicted in FIG. 2. Placing a finger adjacent the hole 19 in the grip portion of exterior tape and pulling in any direction away from the container end 12, vents the container to ambient pressure. This situation is depicted in cross section of FIG. 3. Continued application of removing force to the grip tab reverses the peel direction and begins to peel the body portion of the exterior tape from adjacent the edge of the container end 14. At this point, removing force is transmitted from the grip tab portion to the body portion through the juncture 23 where the two exterior tape portions are securely affixed to each other to form the exterior tape. As the body portion of the exterior tape is peeled from the container end, the interior sheet material is pulled through the pour hole and access to the container contents is gained. Complete opening of the container is depicted in FIG. 4, wherein the T-tab is shown bent away from the pour hole, securing the closure system to the container end and directing the fully opened closure system away from the pour hole.

Peel direction (as discussed above) at two points in the opening process should be noted from FIGS. 3 and 4. In FIG. 3 the peel direction is right to left, and in FIG. 4, the peel direction is left to right. Even if removing force is applied to the grip tap in what appears to be one direction, e.g., normal to the container end, the novel grip tab directs the peel force in two directions to first vent the container and then effectuate container opening. It also should be noted that the grip portion and body portions of the exterior tape are preferably made from different materials. In other words, it is possible to use a very sophisticated, relatively expensive body portion tape to satisfy the rigorous demands put on the body portion and a relatively inexpensive grip portion since all that is required of the grip portion is that it be bondable to the interior sheet material. In this manner, material savings are achieved.

It is critical to the present invention for the grip tab to be bonded to the interior sheet material with sufficient aggressiveness to pull a portion of the interior sheet material through the vent hole and thereby effectuate container venting. One usable technique is to apply additional adhesive (layer 29, in FIG. 3), e.g., a segmented, polyether ester adhesive commercially available from du Pont under the trade designation "Dyvax PB 722", to the interior sheet material. The entire interior sheet material can be coated with additional adhesive or alternatively, only that portion of the interior sheet material interiorly circumjacent the vent opening can be additionally adhesive coated. Another possible means of bonding the grip portion of the exterior tape to the interior sheet material is to use an interior sheet material on which is coextruded a second, more heat sealable layer, e.g., of the type described in U.S. Pat. No. 3,188,266 (Charbonneau et al).

The grip portion of the exterior tape is folded back upon the exterior tape body portion. Where the grip portion overlays the body portion, the grip portion should be lightly tacked onto the body portion so as not to protrude above the rim of the can, thereby interfering with canning and handling operations. One way to insure the grip portion does not protrude above the can end is to make either the grip portion or the body portion of the exterior tape slightly tacky by coating either portion with, for example, a phenoxy resin.

In a preferred embodiment, the body portion of the exterior tape is aluminum color coated. The aluminum color coat solution is made by dissolving, with agitation, 30.2g of a phenoxy resin (e.g., the thermoplastic condensation product of bisphenol 'A', and epichlorohydrin with a molecular weight of about 30,000 having no terminal epoxy groups available from Union Carbide Corporation under the trade designation "Phenoxy PKHH"), in a solvent mixture of 102.5g of methyl ethyl ketone, 82 grams toluol (toluene) and 20.5g diacetone alcohol (4 hydroxy, 4 methyl, 2-pentanone). After the phenoxy resin is dissolved, 23 grams of aluminum pigment paste (65% solids, leafing grade aluminum powder, 200 mesh screen size, less than 74 micrometer, commercially available from Alcan Aluminum Corp. under the trade designation "MD-E515") is added to the solution and dispersed. Within about 30 minutes prior to the coating of the aluminum color coat, a curing agent (polyphenyl polymethyl isocyanate commercially available from the Upjohn Company under the trade designation "PAPI-135") is added to the color coating solution in an amount equal to 30% of the weight of the phenoxy resin used. This entire mixture is coated onto the exterior side of the body portion of the exterior tape to a dry coating weight of approximately 0.1 grains/sq. inch (1.0 mg/sq. cm.), oven drying being accomplished at a temperature in the range of 170° F. (76° C.) to 220° F. (104° C.) for 1 to 2 minutes. To impart a slight tackiness to the body portion of the exterior tape, the aluminum color coated body portion may additionally be coated with a clear, colorless top coat of the above mixture (including the curing agent) leaving out the aluminum pigment paste. A dry coating weight of approximately $8.3\times10^{-3}$ grain/sq. in. (0.084 mg/sq. cm) has been found desirable. Both the aluminum color coat and the slightly tacky top coat are applied using conventional coating methods, e.g., flooding reverse roll, followed by oven drying at a temperature of 180° F. (82° C.) for 2 minutes.

Although the discussion has been directed toward use of the invention on a container having an internal pressure greater than atmospheric pressure, this is not required. It is contemplated that the novel combination disclosed herein could be employed on containers having internal vacua or containers maintained at near atmospheric pressure. Internal containment pressures in the range of about 0.5 to 6 atmospheres at temperatures as high as 100° F. (37° C.), where maintained for as long as 14 days for test purposes are within the contemplation of this invention. It is contemplated that much longer periods are attainable.

Other than the specific requirements discussed herein, workable materials, films, primers, adhesives, etc. used in the practice of this invention are known to those skilled in the art.

What is claimed is:

1. In a hand operable easy opening closure system of the type wherein a flexible exterior tape and interior sheet material are employed to removably seal a preformed opening in an end portion of a container adapted to withstand sub-atmospheric and super-atmospheric pressures, the improvement comprising in combination:

a. a vent opening centrally disposed in said end portion, said vent opening being of sufficient area so as to permit said exterior tape and interior sheet material to be bonded to each other in the area of said vent opening such that removal of said exterior sheet vents said container to ambient pressures by pulling the portion of said interior sheet in said vent opening therethrough, the area of said vent opening not being so large as to cause excessive disturbance of the contents of said container during the venting operation;

b. a pour hole, separated from said vent opening which is disposed adjacent the edge of said end portion;

c. a rectangular exterior tape having a body portion and a grip portion overlapping said body portion, said body portion and grip portion being securely affixed to each other adjacent the edge of said container portion, said body portion being aggressively bonded to said container portion circumjacent and covering said pour hole, and said grip portion being aggressively bonded to said container portion circumjacent and covering said vent opening.

2. A combination according to claim 1 wherein the vent opening is circular.

3. A combination according to claim 2 wherein the circular vent opening has a diameter in the range of about 0.3 cm to about 0.6 cm.

4. A combination according to claim 1 in which there is associated with said external tape means for preventing total separation of said external tape from said container end.

5. A combination according to claim 4 in which said means for preventing total separation of said exterior tape from said container end is a tongue-like protrusion anchored to said end portion and projecting into said pour hole.

6. A combination according to claim 1 in which said container is adapted to withstand internal pressures in the range of about 0.5 to 6 atmospheres at temperatures less than 37° C., where said temperatures are maintained for at least 14 days.

7. In a hand operable, easy-opening closure system of the type wherein a flexible exterior tape and interior sheet material are employed to removably seal a pour hole and vent opening in a circular end portion of a container adapted to contain pressurized beverages, said vent opening being centrally disposed in said end portion and said pour hole being disposed adjacent the edge of said end portion, a rectangular exterior tape comprising:

a body portion and a securely affixed grip portion, said body portion being aggressively bonded to said container portion circumjacent and covering said pour hole, said grip portion overlapping said body portion and being bonded to said container circumjacent and covering said vent opening, wherein said body portion is aggressively bonded to said interior sheet material in the area of said pour hole and said grip portion is aggressively bonded to said interior sheet material in the area of said vent opening.

* * * * *